US005116154A

United States Patent [19]

Fulkerson

[11] Patent Number: 5,116,154

[45] Date of Patent: May 26, 1992

[54] SPRING-LOADED BOTTLE CAP/APPLICATOR APPARATUS

[76] Inventor: Gary E. Fulkerson, 673 Center Ridge, South Lyon, Mich. 48178

[21] Appl. No.: 711,628

[22] Filed: Jun. 6, 1991

[51] Int. Cl.[5] ..... A46B 11/00; A45D 34/00

[52] U.S. Cl. ..... 401/127; 401/129

[58] Field of Search ..... 401/127, 129

[56] References Cited

U.S. PATENT DOCUMENTS

| | | | |
|---|---|---|---|
| 41,422 | 2/1864 | Burnet . | |
| 48,508 | 7/1865 | Boughton | 401/127 |
| 304,134 | 8/1884 | Rosnecht . | |
| 342,206 | 5/1886 | Hudswell . | |
| 558,245 | 4/1896 | Williams . | |
| 562,134 | 6/1896 | Haner . | |
| 580,013 | 4/1897 | Smith . | |
| 1,117,863 | 11/1914 | Larson . | |
| 2,461,893 | 2/1949 | Guagliano . | |
| 2,538,447 | 1/1951 | Finney . | |
| 3,246,657 | 4/1966 | Roller, Sr. . | |
| 3,694,096 | 9/1972 | Seidler . | |
| 4,313,686 | 2/1982 | Proffer | 401/127 |
| 4,376,591 | 3/1983 | Proffer . | |
| 4,841,996 | 6/1989 | Gueret | 401/27 X |
| 4,917,520 | 4/1990 | Reid | 401/127 |

FOREIGN PATENT DOCUMENTS

| | | | |
|---|---|---|---|
| 209361 | 1/1987 | European Pat. Off. | 401/127 |
| 3000411 | 7/1981 | Fed. Rep. of Germany | 401/127 |
| 101022 | 3/1941 | Sweden | 401/127 |

*Primary Examiner*—Steven A. Bratlie

*Attorney, Agent, or Firm*—Harness, Dickey & Pierce

[57] ABSTRACT

A spring-loaded bottle cap/applicator apparatus for enabling the contents at the very most bottom portion of a container such as a nail polish bottle to be reached by a brush of the apparatus. A cap assembly, a brush member, and a coil spring are disposed within the cap assembly to bias the brush member outwardly relative to the upper cap member when said cap assembly is not threadably engaged with a threaded neck portion of the container. An outwardly protruding shoulder portion disposed on a base portion of the brush member limits the outward travel of the brush member and holds the brush member captively within the cap assembly. The construction of the cap assembly, in conjunction with the construction of the brush member, enables the apparatus to be constructed simply, quickly easily, and inexpensively to produce a bottle/cap applicator which is capable of reaching the very lowermost contents of the container with which it is secured, and which is maintained at a predetermined position within the container as the cap assembly is threadably screwed onto the neck portion of the container.

12 Claims, 2 Drawing Sheets

SPRING-LOADED BOTTLE CAP/APPLICATOR APPARATUS

BACKGROUND OF THE INVENTION

1. Technical Field

This application relates generally to bottle cap assemblies, and more particularly to a spring-loaded bottle cap/applicator apparatus particularly well-suited for moving fluids from the very lowermost interior surface of a container such as a nail polish bottle.

2. Discussion

Cap assemblies having elongated brush members are used in a wide variety of applications such as with nail polish bottles, small paint jars, and a wide variety of applications where it is necessary to withdraw liquids or semi-solid compounds from the interior area of a jar or bottle containing such fluids or compounds.

With prior art cap/brush assemblies, the brush has to be of a length to enable the cap to which it is secured to be threadably engaged with a neck of a bottle without causing the brush to be forcibly urged into a lowermost interior surface of the bottle, which would thereby damage and/or deform the brush and possibly a stem member to which the brush may be attached. Accordingly, when such prior art cap assemblies are designed, an amount of clearance between the very bottom of the brush and the lowermost interior surface of the bottle must be allowed for, which clearance represents substantially the distance which the cap travels downwardly onto the neck portion as the cap is threaded onto the neck portion of the bottle. Thus, the brush does not reach down to closely adjacent the lowermost inner surface of the container bottle and the contents at the lower surface of the bottle cannot be reached and withdrawn by the brush unless the cap is screwed completely downwardly onto the neck portion of the bottle.

The inability of prior art cap/brush assemblies to reach down into the very lowermost portion of the bottle or container with which they are used adds significantly to the inconvenience in using such caps/brush assemblies. This is because the cap must be threaded downwardly completely onto the neck portion of the bottle each time the brush is inserted into the bottle to reach the very lowermost interior area of the bottle, and then threadably unscrewed from the neck of the container.

In addition to the significant inconvenience that conventional cap/brush assemblies introduce in day-to-day use, the inability to reach fluids at the lowermost interior areas of bottles with which such cap/brush assemblies are used often produces a significant amount of waste when such bottles are discarded with appreciable amounts of fluids therein. This problem is particularly well exemplified with reference to nail polish and nail polish remover containers. With businesses involved in the beauty industry, which businesses use very large quantities of nail polish and nail polish remover, the waste represented by the fluid which is inaccessible by conventional prior art cap/brush assemblies can translate into very significant monetary losses accumulated over even relatively short periods of time.

Accordingly, it is a principal object of the present invention to provide a cap/applicator apparatus which is operable to extend downwardly to a point closely adjacent a very lowermost inner surface of a bottle or other like container such as a nail polish bottle, without threadably screwing the cap/applicator apparatus down onto a neck portion of the bottle, and which includes a brush member which remains generally stationary relative to the bottle while the cap of the apparatus is threadably screwed onto the threaded neck portion of the bottle.

It is still a further object of the present invention to provide a spring-loaded bottle cap/applicator apparatus which includes a coil spring held captively within a cap assembly of the apparatus, where the spring is operable to maintain the brush member in an outwardly biased position relative to the cap assembly when the cap assembly is not threadably engaged with a neck portion of a bottle with which it is coupled to.

It is still a further object of the present invention to provide a spring-loaded bottle cap/applicator apparatus which is extremely simple to construct and which includes a minimum number of components to thereby reduce significantly the complexity of manufacturing the apparatus, while also reducing significantly the cost associated with its manufacture.

SUMMARY OF THE INVENTION

A spring-loaded bottle cap/applicator apparatus is disclosed in connection with the preferred embodiments of the present invention. The apparatus generally includes a cap assembly, a brush member and a biasing means such as a spring. The brush member includes a base portion which is held captively within a portion of the cap assembly. The spring is also disposed within the cap assembly and operates to bias the brush member outwardly when the apparatus is not threadably secured to the neck portion of a container.

The apparatus enables the cap assembly to be threadably secured onto the threaded neck portion of a container while the brush member remains relatively stationary with respect to the container. Thus, the brush member may be of a length to enable it to reach down to a very lowermost area of an associated container without threadably securing the apparatus to the container. Furthermore, the brush member is not driven into excessive abutting engagement with the lowermost inner surface of the container when the apparatus is threadably secured to a neck portion of the container.

In an alternative preferred embodiment of the present invention, a single-piece cap body is disclosed. The single-piece construction of the cap body even further enhances its manufacture.

In another alternative preferred embodiment of the present invention, a single-piece cap body having a hinged top portion is disclosed. The hinged top portion enables an alternative preferred method of assembly to be effected.

DETAILED DESCRIPTION OF THE PREFERRED EMBODIMENTS

Figure 1:
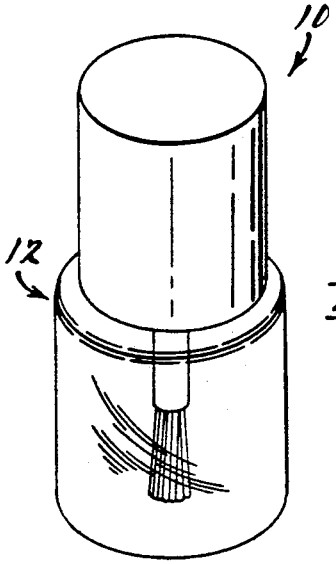
FIG. 1 is an elevational perspective view of the spring-loaded bottle cap/applicator apparatus of the present invention.

Referring now to FIG. 1, there is shown a spring-loaded bottle cap/applicator apparatus 10 in accordance with a preferred embodiment of the present invention. The apparatus 10 is further shown threadably coupled to a generally circular container 12 which may represent a bottle such as a bottle for holding nail polish or nail polish remover, or a jar or any other like container.

Figure 3:
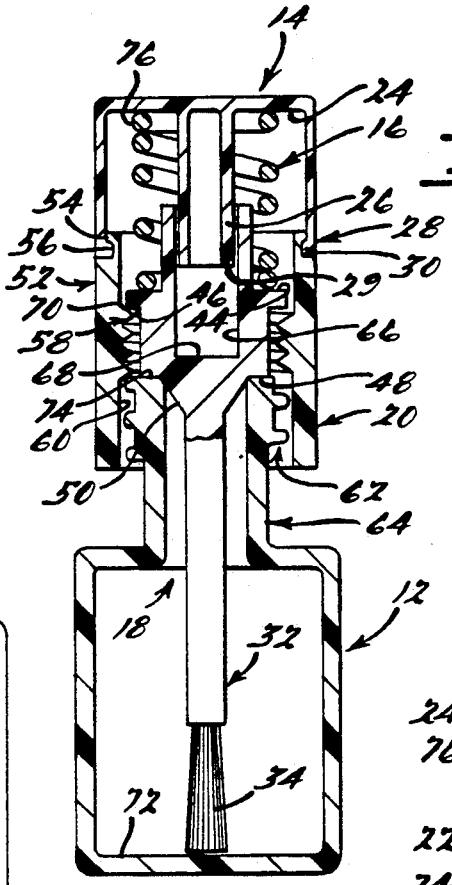
FIG. 3 is a cross-sectional side view of the apparatus with the brush member thereof disposed within a container while the cap assembly of the apparatus remains unsecured to the neck portion of the container.
Figure 2:
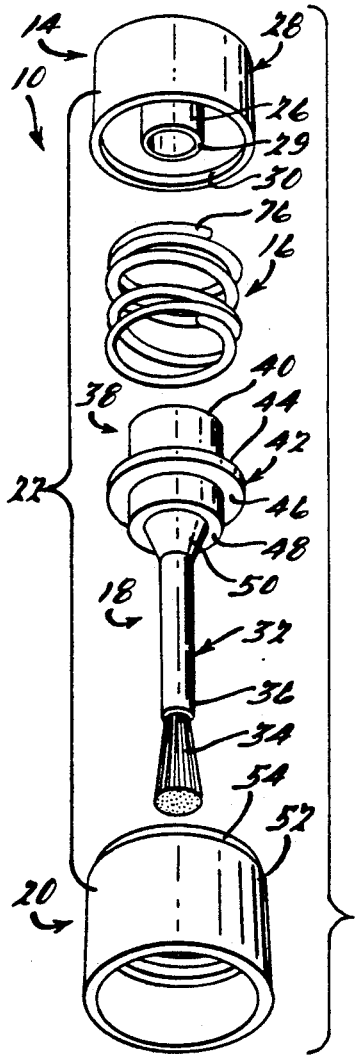
FIG. 2 is an exploded perspective view of the components of the apparatus of FIG. 1.

Referring now to FIGS. 2 and 3, the various components and construction of the apparatus 10 can be seen more clearly. The apparatus 10 generally includes an upper cap member 14, a coil spring 16, a brush member 18, and threaded means in the form of a lower cap member 20. Together, upper and lower cap members 14 and 20 form a cap assembly 22, which will be described in more detail momentarily.

The upper cap member 14 includes an inner upper surface 24, a coaxially disposed, boss portion 26 depending downwardly of inner upper surface 24 and having a lower surface 29, and an inwardly directed shoulder portion 30. The upper cap member 14 is preferably a single piece, integrally formed component although it should be appreciated that boss portion 26 and inwardly directed shoulder portion 30 could be constructed separately and secured to upper cap member 14 by conventional means if so desired.

The brush member 18 of apparatus 10 includes a generally cylindrical, elongated stem portion 32 having an applicator brush 34 secured at a lowermost end portion 36 of the stem portion 32. The stem portion 32 is integrally formed with a generally circular-shaped base portion 38. The base portion 38 has an upper surface 40 and an outwardly protruding shoulder portion 42 extending circumferentially therearound. The outwardly protruding shoulder portion 42 is spaced preferably about halfway along the longitudinal length of the base portion 38 and includes an upper surface 44 and a lower surface 46.

The base portion 38 further includes a lower shoulder portion 48 having a frusto-conical shaped portion 50 extending therefrom from which stem portion 32 extends. It should also be appreciated that while brush member 18 is preferably integrally formed as a single component (with the exception of applicator brush 34,) brush member 18 could be formed from separate components if so desired.

Figure 4:
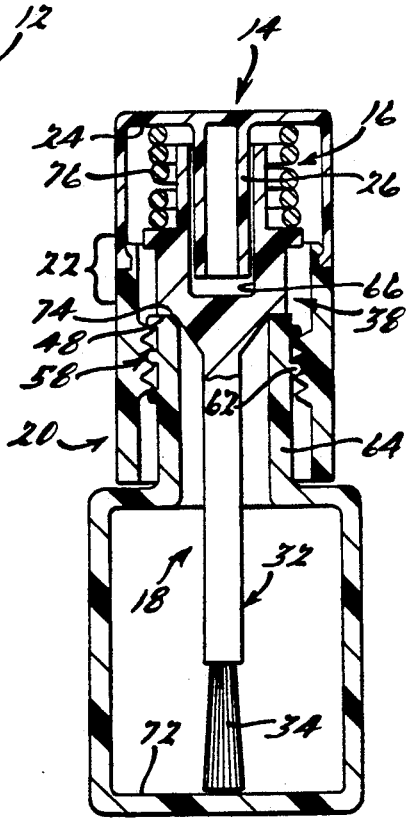
FIG. 4 is a side cross-sectional view of the apparatus showing the cap assembly completely threadably engaged with the neck portion of a container and the spring of the apparatus compressed to enable the threaded engagement.

The lower cap member 20 of apparatus 10 includes an upper end portion 52 having an uppermost shoulder portion 54, which is best illustrated in FIGS. 3 and 4. The uppermost shoulder portion 54 extends circumferentially about the periphery of the upper end portion 52 of the lower cap member 20 to form a circumferentially extending groove 56 therearound. Further included is an inner threaded portion 58 circumferentially disposed about a portion of an inner surface 60 of the lower cap member 20. Threaded portion 58 is adapted to be secured to a threaded portion 62 of a neck 64 of container 12.

With specific reference to FIGS. 3 and 4, base portion 38 of brush member 18 further includes a coaxially disposed recessed portion 66 having a bottom surface 68. The recessed portion 66 extends downwardly into base portion 38 preferably for a majority of the longitudinal length of base portion 38.

When the apparatus 10 is in assembled form, the spring 16 is held captively within upper and lower cap members 14 and 20, respectively, and in abutting contact with inner upper surface 24 of upper cap member 14 and upper surface 44 of outwardly protruding shoulder portion 42. To prevent the spring 16 from forcing the brush member 18 completely out of the cap members 14 and 20, the lower surface 46 of outwardly protruding shoulder portion 42 abuttingly engages a thread portion 70 of inner threaded portion 58, which thereby prevents the brush member 18 from being urged completely outwardly from the cap members 14 and 20, and thereby captively maintains the brush member 18 within the cap members 14 and 20.

From FIG. 3, it can be seen that the stem portion 32 of brush member 18 is of a length sufficient to enable applicator brush 34 to reach to a position very closely adjacent an interior lower surface 72 of container 12 when the apparatus 10 is inserted into container 12, and the inward travel 10 of brush member 18 is reached by abutting contact of lower surface 48 of base portion 38 with an upper surface 74 of neck portion 64. Accordingly, the cap assembly 22 formed by upper and lower cap members 14 and 20 need not be threadably screwed onto neck portion 64 of container 12 to enable applicator brush 34 to reach down to the very lowermost contents of the container 12. This significantly enhances the ease with which liquids and other semi-solid fluids can be removed from the very lowermost area of container 12. With many prior art devices, the brush member must be of a length sufficiently short enough to allow the cap to be threadably screwed onto the neck of a container without causing the brush or the stem securing the brush to be driven into the very bottom of the container, thereby deforming the brush and possibly even the stem portion securing the brush. Thus, the apparatus 10 of the present invention enables the very lowermost contents of a container to be extracted via applicator brush 34 without manually threading cap assembly 22 completely onto the neck portion 64 of the container 12.

The apparatus 10 can contribute to significant cost savings in the form of enabling a user to more completely extract the contents of a container associated with the apparatus 10. For example, with businesses connected with the beauty industry, where a very high volume of liquids such as nail polish and nail polish remover are used, the ability to more completely and thoroughly extract the contents of containers in a quick, easy and convenient manner can represent a significant cost savings to such businesses even over a relatively short period of time. With many prior art containers, typically 10 percent or more of the fluid within the container is wasted. Thus, the apparatus 10 enables much more efficient and convenient extraction of liquids at the very lowermost portion of a container without the attending inconveniences normally associated with prior art cap/brush devices.

Referring specifically now to FIG. 4, the apparatus 10 can be seen threaded down over neck portion 64 of container 12. As will be apparent from viewing FIGS. 3 and 4 together, as the cap assembly 22 is screwed threadably down onto neck portion 64 of container 12, boss portion 26 moves slidably down into recessed portion 66 of base portion 38. During the time in which cap assembly 22 is being threadably screwed onto neck portion 64, base portion 38, and consequently stem portion 32 and applicator brush 34, are held relatively stationary with respect to container 12 by abutting contact of lower surface 48 of base portion 38 with upper surface 74 of neck portion 64. As the cap assembly 22 is rotated threadably downwardly, spring 16 is compressed. The bottom surface 68 of recessed portion 66 may be of such a depth so as to limit the total movement of cap assembly 22 relative to base portion 18 to a predetermined distance if so desired. Alternatively, the overall length of the cap assembly 22 may be such as to limit the total downward movement of cap assembly 22 relative to container 12.

By enabling the cap assembly 22 to be threaded downwardly onto neck portion 64 while brush member 18 is held relatively stationary with respect to the container 12, the stem portion 32 can be made of such a length to enable it to extend applicator brush 34 down to the very lowermost interior area of the container 12 without causing the applicator brush 34 to be driven forcibly into the lower interior surface 72 when the cap assembly 22 is secured to the container 12.

The brush member 18 and cap members 14 and 20 may be made from a wide variety of materials but are preferably injection molded from plastic due to the relatively high strength characteristics provided by plastics, in addition to their relatively light weight.

With reference to FIGS. 2, 3 and 4, the apparatus 10 may be constructed in accordance with a uniquely simple method quickly, easily and in most cases without the need for special tools or the like. Initially, brush member 18 is placed in relative coaxial alignment with lower cap member 20 and spaced closely adjacent the uppermost shoulder portion 54 of the lower cap member 20. Brush member 18 is then inserted through lower cap member 20 to place the lower surface 46 of base portion 38 in abutting contact with threaded portion 70 of inner threaded portion 58 of cap member 20. While spring 16 is being held with an upper end portion 76 thereof in abutting contact with inner upper surface 24 of the upper cap member 14, the upper cap member 14 may be urged towards and over uppermost shoulder portion 54 of the lower cap member 20. The inwardly directed shoulder portion 30 of the upper cap member 14 snappingly engages within groove 56, thereby helping to hold cap members 14 and 20 securely together against the biasing force of spring 16, which tends to urge brush member 18 outwardly of the upper cap member 14 and to maintain the brush member 18 in such an outwardly biased position.

Figure 5:
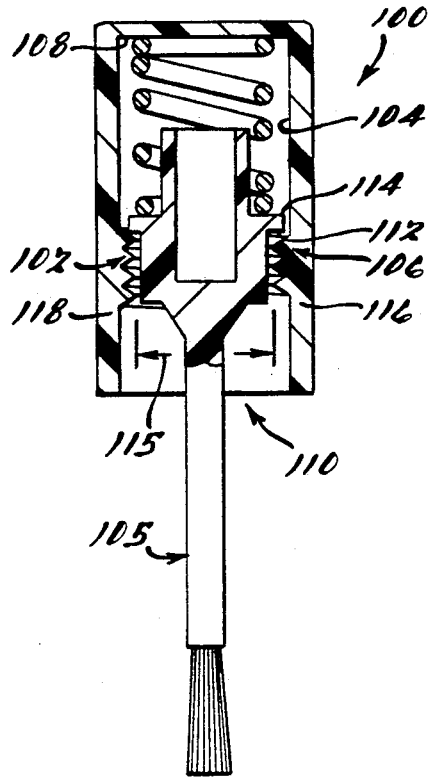
FIG. 5 is an illustration of an alternative preferred embodiment of the present invention showing a single-piece cap member.

Referring now to FIG. 5, a one-piece cap member 100 is shown in accordance with an alternative preferred embodiment of the present invention. This embodiment 100 includes an inner threaded portion 102, a relatively smooth inner surface 104, a threaded portion 106, and a relatively smooth inner upper surface 108. The brush member 105 is identical to brush member 18 of FIGS. 1-4. The brush member 105 similarly engages threaded portion 106 to maintain a portion of the brush member 105 captively within the cap member 100.

It is anticipated that one-piece cap member 100 will be preferred by manufacturers from a manufacturing standpoint due to the even further increased ease, and reduced cost, with which cap member 100 may be produced.

When assembling brush member 105 into cap member 100, brush member 105 is inserted up from a lower end 110 of cap member 100 and urged over the threads of threaded portion 102 until a lower surface 112 of the brush member 105 completely clears threaded portion 106. The outer diameter of an outwardly protruding shoulder portion 114 of the brush member is preferably only about 0.125 inches greater than the diameter 115 of threaded portion 102. Since the one-piece cap member 100 is also preferably injection-molded from plastic or another like compound, wall portions 116 and 118 of the cap body 100 are able to flex outwardly slightly to facilitate manual insertion of the shoulder portion 114 of brush member 105 past threaded portion 102. Accordingly, no special tools or processes are required to assemble the brush member 105 captively within the one-piece cap member 100.

Figure 6:
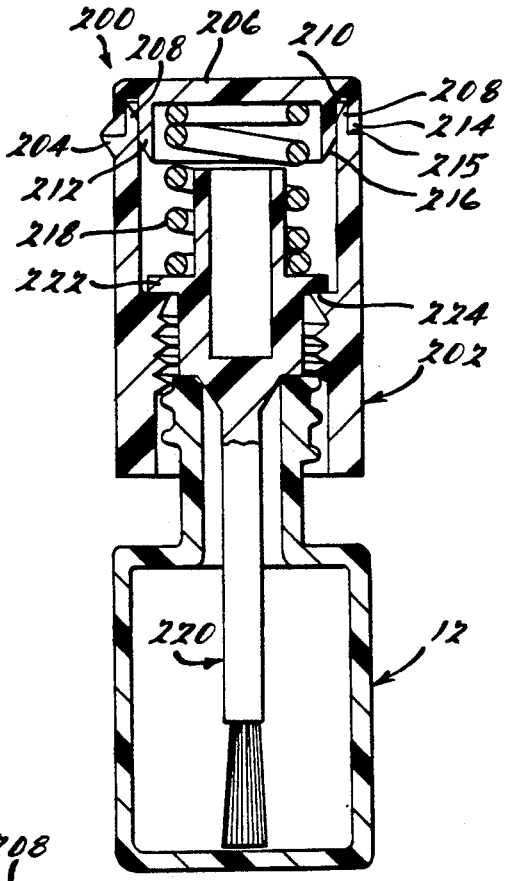
FIG. 6 is an illustration of another preferred embodiment of the present invention showing a cap member having a hinged top surface.
Figure 7:
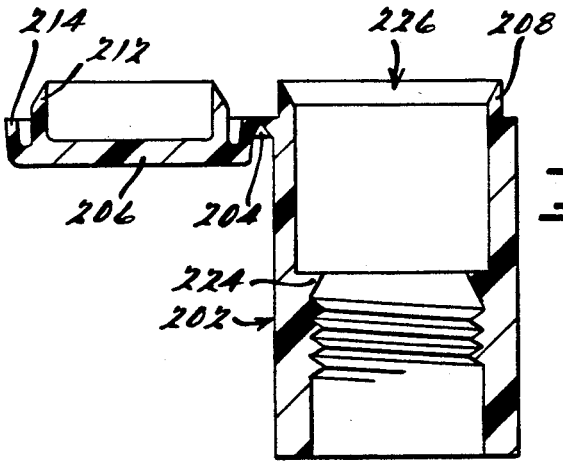
FIG. 7 is an illustration of the cap member shown in FIG. 6 with the top portion thereof in an open condition.
Figure 8:
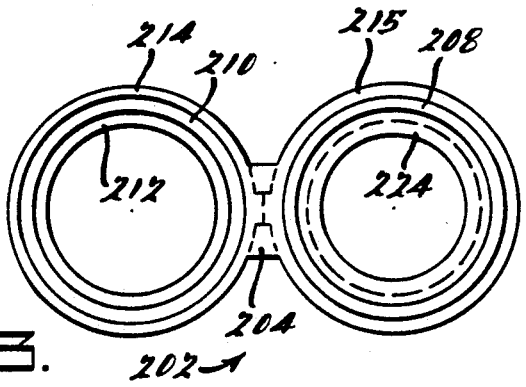
FIG. 8 is a plan view of the cap member of FIG. 7.

With reference now to FIGS. 6-8, a bottle cap/applicator apparatus 200 in accordance with another alternative preferred embodiment of the present invention is shown. This apparatus 200 incorporates a one-piece, hinged cap member 202 having a sidewall portion 203, an integrally formed hinge portion 204 and a top portion 206 integrally formed with the hinge portion 204, and an internal, inwardly extending shoulder portion 207. The cap member 202 further includes an upwardly extending rim portion 208 which is adapted to fit lockably within a generally circular channel 210 of top portion 206. Channel 210 is formed by an inner rim portion 212 and an outer rim portion 214. The inner and outer rim portions 212 and 214, respectively, further extend downwardly, with inner rim portion 212 including an angled surface 216 to further facilitate smooth engagement of rim portion 208 within channel 210.

The diameter of the generally circular channel 210 is further slightly greater, preferably by about 0.010 inches, than the diameter of rim portion 208. Thus, when the top portion 206 is closed and rim portion 208 is urged into channel 210, a tensioned, locking engagement occurs between rim portion 208 and channel 210 to hold the top portion 206 closed, as shown in FIG. 6, against the biasing force exerted by a spring 218 disposed within the cap body 202.

Further illustrated in FIG. 6 is a brush member 220 which is identical to brush member 18 and brush member 105 with the exception of an enlarged, outwardly extending shoulder portion 222. Shoulder portion 222 is adapted to engage with the inwardly extending shoulder portion 207 of the cap member 202 to thereby maintain the brush member 220 captively within the cap member 202 when a biasing force is exerted against the brush member 220 by spring 218.

With reference to FIGS. 7 and 8, the cap member 202 is shown with top portion 206 fully opened. The hinge portion 204, being integrally formed with the top portion 206 and sidewall portion 203, is known in the art as a "living hinge". In FIG. 8, the generally circular channel 210 formed by inner and outer rim portions 212 and 214 respectively, as well as the rim portion 208 of the cap member 202 are shown.

The cap member 202 is preferably injection-molded from plastic and can be quickly, easily, efficiently and relatively inexpensively produced in large quantities if so desired. To assemble brush member 220 within the cap member 202, the top portion 206 is first opened as shown in FIGS. 7 and 8. Brush member 220 is then inserted through an upper opening 226 in the cap member 202 until the shoulder portion 222 of the brush member 220 rests against the inwardly extending shoulder portion 207 of the cap member 202. The spring 218 is then inserted through opening 226 and top portion 206 is closed as shown in FIG. 6. Thus, no special tools or other equipment are needed to quickly, easily and efficiently assemble embodiment 200 of the present invention.

Accordingly, it should be appreciated that the above-described method of construction provides a particularly simple, unique, easy and effective manner of constructing the apparatus 10 without the need for special tools or the like. The simplicity and ease of the assembly process described above enables the apparatus to be constructed quickly, easily and relatively inexpensively in large quantities if so desired.

While the apparatus 10 of the invention has been described in connection with a container 12 such as a nail polish bottle, it should be appreciated that the apparatus 10 is suited for use with containers used in a wide variety of applications. For example, relatively small bottles of touch-up paint often are supplied with cap/-brush assemblies of the prior art variety. By incorporating the spring-loaded bottle cap/applicator apparatus 10 of the present invention, the advantages enumerated herein could be realized just as easily with touch-up paint bottles. The use of certain containers used in other areas, such as for example in the medical field, could very well be enhanced by the teachings of the present invention.

While the above description constitutes the preferred embodiments of the invention, it will be appreciated that the invention is susceptible to modification, variation, and change without departing from the proper scope or fair meaning of the accompanying claims.

What is claimed is:

1. A spring-loaded bottle cap/applicator apparatus for enabling extraction of fluids and semi-solids from a bottom surface of a bottle, jar and other like containers, said apparatus comprising:

a brush member having an elongated stem portion and a base portion, a lowermost end portion of said elongated stem portion having an applicator brush secured thereto, said base portion including a lower shoulder portion and an outwardly protruding shoulder portion spaced longitudinally apart from said lower shoulder portion, said base portion further including an uppermost end portion, said lower shoulder portion of said brush member being positioned at a predetermined point along a length of said brush member to provide said elongated stem portion a length sufficient to enable said applicator brush to reach to a position closely adjacent an interior lower surface of a container;

an integrally formed cap member having an inner upper surface;

biasing means disposed inbetween said inner upper surface of said cap member and an upper surface of said outwardly protruding shoulder portion of said base portion for biasing said brush member linearly outwardly of said cap member when said brush member is not threadably secured to a threaded neck portion of a container; and threaded means operatively associated with said cap member for limiting the outward linear movement of said brush member relative to said cap member and for threadably engaging said threaded neck portion of said container as said apparatus is threadably secured to said threaded neck portion, said inner upper surface of said cap member being able to move independently relative to said brush member;

said applicator brush being operable to reach to said position closely adjacent said interior lower surface of said container without being threadably secured to said threaded neck portion of said container when said elongated stem portion is inserted through said threaded neck portion; and whereby said threaded means may be threadably secured to said threaded neck portion while said brush member is inserted through said threaded neck portion into said container and said lower shoulder portion of said base portion is in abutting contact with an upper surface of said neck portion, said brush member thereby being held stationary relative to said container and said cap member regardless if said threaded means are threadably engaged with, or disengaged from, said neck portion.

2. The apparatus of claim 1, wherein said cap member further comprises a lower edge portion having an inwardly directed shoulder portion; and wherein said means for limiting outward linear movement of said brush member comprises a lower cap member having an uppermost shoulder portion adapted to snappingly engage with said inwardly directed shoulder portion of said lower edge portion of said cap member, a portion of said lower cap member being operable to engage a lower surface of said outwardly protruding shoulder portion.

3. The apparatus of claim 1, wherein said biasing means comprises a coil spring.

4. The apparatus of claim 1, wherein said brush member includes a coaxially disposed recessed portion within a portion of said base portion and said cap member includes a depending boss portion operable to move slidably within said recessed portion, said recessed portion including a lower surface operable to limit the slidable movement of said boss portion to a predetermined distance as said cap member is threadably screwed onto said threaded neck portion of said container.

5. The apparatus of claim 1, wherein said cap member includes an upper cap member and a lower cap member which cooperatively form a cap assembly; and said lower cap member including said means for limiting outward linear movement of said brush member.

6. The apparatus of claim 1, wherein said cap member includes an integrally formed, one-piece cap body.

7. The apparatus of claim 1, wherein said cap member comprises an integrally formed, one-piece cap member having a hinged top portion and an upper rim portion, said top portion including said inner upper surface, said top portion being operable to be hingedly opened and urged into a lockably closed position relative to said upper rim portion of said cap member.

8. A spring-loaded bottle cap/applicator apparatus for enabling access to a lower interior surface of a bottle, jar or other like container, said apparatus comprising:

a brush member having a generally cylindrical, elongated stem portion and a generally cylindrical base portion, said stem portion having a lower most end portion including an applicator brush affixed securely thereto, said base portion having a lower shoulder portion and an uppermost end portion, said base portion further including a coaxially disposed generally cylindrical recessed portion extending partially downwardly therein, said base portion further including an outwardly protruding shoulder portion extending circumferentially therearound, said outwardly protruding shoulder portion having upper and lower surfaces and being spaced longitudinally apart from said uppermost end portion of said base portion, said lower shoulder portion of said brush member being positioned at a predetermined point along a length of said brush member to provide said elongated stem portion a length sufficient to enable said applicator brush to reach to a position closely adjacent an interior lower surface of a container;

a cap assembly having an integrally formed upper cap member and a lower cap member;

said upper cap member having an inner upper surface and a coaxially disposed, downwardly depending boss portion generally circular in shape, and a lower edge portion having an inwardly directed shoulder portion extending circumferentially therearound;

said lower cap member being of a generally circular shape and of a diameter approximately equal to a diameter of said upper cap member, said lower cap member including an upper shoulder portion forming a groove extending circumferentially about an upper end portion of said lower cap member, said lower cap member further including an inner threaded portion;

said groove of said lower cap member being operable to snappingly engage with said inwardly directed shoulder portion of said upper cap member to thereby secure said upper and lower cap members together; and a coil spring having an upper end and a lower end, said coil spring being disposed inbetween said inner upper surface of said upper cap member and said upper surface of said outwardly protruding shoulder portion of said base portion when said upper and lower cap members are snappingly secured together;

said cap assembly being threadably engageable with a threaded neck portion of a container while said brush member is disposed within said container, said boss portion of said upper cap member being operable to be urged slidably inwardly into said recessed portion of said base portion as said cap assembly is threadably screwed onto said threaded neck portion and while said brush member is being held stationary relative to said threaded neck portion by abutting contact with an upper surface of said neck portion with said lower shoulder portion of said base portion, said brush member thus being independently movable relative to said inner upper surface of said upper cap member;

a portion of said inner threaded portion of said lower cap member operating to limit an outward travel of said brush member via abutting contact with said lower surface of said outwardly protruding shoulder portion as said brush member is biased outwardly relative to said upper cap member by said coil spring.

9. The apparatus of claim 8, wherein said outwardly protruding shoulder portion of said base portion is spaced at about a mid-portion of a longitudinal length of said base portion.

10. A method of constructing a spring-loaded bottle cap/applicator apparatus, wherein said apparatus comprises a cap assembly having upper and lower cap members, said upper cap member having a lower edge portion having an inwardly directed shoulder portion, and said lower cap member having an uppermost shoulder portion defining a groove, said lower cap member further having an inner threaded portion, and further providing a brush member having a base portion, said base portion including an outwardly protruding shoulder portion having an upper and a lower surface, and further providing a spring disposed within said upper cap member, said method comprising the steps of:

disposing said brush member within said lower cap member so as to place said lower surface of said outwardly protruding shoulder portion of said base portion in abutting contact with a portion of said inner threaded portion of said lower cap member;

placing said upper and lower cap members in relative coaxial alignment with said inwardly directed shoulder portion of said upper cap member being spaced closely adjacent said uppermost shoulder portion of said lower cap member;

urging said upper cap member toward said lower cap member against a biasing force generated by said spring as said spring is compressed against an inner upper surface of said upper cap member and an upper surface of said outwardly protruding shoulder portion of said base portion of said brush member to force said inwardly directly shoulder portion into snapping engagement within a groove formed by said uppermost shoulder portion of said lower cap member;

whereby said groove of said lower cap member and said inwardly directed shoulder portion of said upper cap member operate cooperatively to lock said upper and lower cap members securely together, and whereby said brush member is held captively within said cap assembly and said brush member is free to move slidably, independently relative to said inner upper surface of said upper cap member.

11. A spring-loaded bottle cap/applicator apparatus for enabling extraction of fluids and semi-solids from a bottom surface of a bottle, jar and other like containers, said apparatus comprising:

a brush member having an elongated stem portion and a base portion, a lowermost end portion of said stem portion having an applicator brush secured thereto, said base portion including a lower shoulder portion and an outwardly protruding shoulder portion spaced longitudinally apart from said lower portion, said base portion further including an uppermost end portion, said lower shoulder portion being positioned at a predetermined point along a length of said brush member to provide said elongated stem portion a length sufficient to enable said applicator brush to reach to a position closely adjacent an interior lower surface of a container;

an integrally formed, single-piece cap member, said cap member including an internal, inwardly extending shoulder portion, an interior threaded portion, an upwardly extending rim portion, and a hinged top portion operable to be hingedly opened and urged into a lockably closed position relative to said rim portion, said hinged top portion having an inner upper surface;

biasing means disposed inbetween said top portion of said cap member and an upper surface of said outwardly protruding shoulder portion of said base portion for biasing said brush member linearly outwardly of said cap body when said brush member is not threadably secured to a threaded neck portion of a container; and said inwardly extending shoulder portion being operable to abuttingly engage a lower surface of said outwardly protruding shoulder portion of said brush member to thereby limit outward linear movement of said brush member relative to said cap member;

whereby said elongated stem portion of said brush member may be inserted through a threaded neck portion of a container to dispose said applicator brush closely adjacent an interior lower surface of said container, and wherein said interior threaded portion of said cap member may be threadably secured to said threaded neck portion of said container while said brush member is inserted through said threaded neck portion into said container and said lower shoulder portion of said base portion is in abutting contact with an upper surface of said neck portion, said brush member thereby being held stationary relative to said container in said cap body while said interior threaded portion is threadably engaged with said neck portion of said container, said brush member being operable to move slidably independently relative to said inner upper surface of said hinged top portion of said cap member.

12. A method of constructing a spring-loaded bottle cap/applicator apparatus, wherein said apparatus comprises a cap member having an upwardly extending rim portion, including a sidewall portion, a top portion and a hinge integrally formed with said side wall and top portions, said top portion further including a channel portion operable to lockably engage with said upwardly extending rim portion, said sidewall portion further including an internal, inwardly extending shoulder portion and an inner threaded portion, and further providing a brush member having a base portion, said base portion including an outwardly protruding shoulder portion having an upper and a lower surface, and further providing a spring, the method comprising:

moving said top portion of said cap member to an open position;

inserting said brush member through an upper end of said cap member and disposing said brush member so that said lower surface of said outwardly protruding shoulder portion is in abutting contact with said inwardly extending shoulder portion of said cap member;

disposing said spring within said cap member and in abutting contact with said upper surface of said outwardly protruding shoulder portion;

urging said top portion into a closed position, whereby said upwardly extending rim portion lockably engages with said channel of said top portion, thereby compressing said spring to thereby maintain said brush member in an outwardly biased manner relative to said cap body, said brush member being operable to move independently of cap member.

* * * * *